US005478278A

United States Patent [19]

Greenblatt

[11] Patent Number: 5,478,278

[45] Date of Patent: Dec. 26, 1995

[54] INNER BREAST CUP INSERT FOR WOMEN'S GARMENT

[76] Inventor: Irwin Greenblatt, 145 W. 67th St. #10G, New York, N.Y. 10023

[21] Appl. No.: 270,301

[22] Filed: Jun. 30, 1994

Related U.S. Application Data

[63] Continuation of Ser. No. 974,961, Nov. 12, 1992, abandoned.

[51] Int. Cl.[6] ..... A41C 3/08

[52] U.S. Cl. ..... 450/32; 450/30; 450/31; 450/57; 2/67; 2/73

[58] Field of Search ..... 2/67, 73, 105, 2/106, 107, 109, 110, 115, 244, 113, 114; 450/30, 31, 32, 33, 37, 38, 53, 54, 55, 56, 57

[56] References Cited

U.S. PATENT DOCUMENTS

| | | | |
|---|---|---|---|
| 1,254,043 | 1/1918 | James | 450/31 |
| 1,844,888 | 2/1932 | Lorenz . | |
| 1,990,322 | 2/1935 | Goldberg | 450/31 |
| 2,099,949 | 11/1937 | Wangenheim | 450/32 |
| 2,268,781 | 1/1942 | Slotoroff | 450/32 |
| 2,359,804 | 10/1944 | Struthers | 450/32 |
| 2,428,175 | 9/1947 | Norton | 2/74 |
| 2,592,265 | 4/1952 | Fyffe | 2/67 X |
| 2,671,218 | 3/1954 | Luhr | 2/67 |
| 2,863,460 | 12/1958 | Monroe | 128/435 |
| 3,161,200 | 12/1964 | Brickman | 128/455 |
| 3,255,754 | 6/1966 | Brumberger | 128/479 |
| 3,436,762 | 4/1969 | Cahan | 2/67 |
| 4,100,621 | 7/1978 | Ettipro | 2/114 |
| 4,343,313 | 8/1982 | LeJeune | 128/505 |

FOREIGN PATENT DOCUMENTS

| | | | |
|---|---|---|---|
| 775675 | 1/1935 | France | 2/67 |

OTHER PUBLICATIONS

Gershman, Maurice, "Self Adhering Nylon Tapes." The J.A.M.A., vol. 168, No. 7, 1958.

*Primary Examiner*—Jeanette E. Chapman

[57] ABSTRACT

An adjustable inner breast cup insert assembly for a woman's swimsuit or garment such as a leotard, dancewear, etc. The inner breast cup insert assembly comprises two breast cups connected at a midsection. Each breast cup contains a vertical extension and a side extension. Attached to the vertical extensions and side extensions of the breast cups is fastening material such as hook and loop type fasteners. On an inner side of the shoulder area and side seams of the under arm area of the swimsuit or garment is attached complimentary fastening material. The fastening material of the inner breast cup insert assembly is connected to the fastening material of the swimsuit or garment, thereby securely anchoring the insert assembly to the swimsuit or garment and providing proper fit, choice of size, proper support, comfort, shape and desired look to a wearer.

20 Claims, 5 Drawing Sheets

INNER BREAST CUP INSERT FOR WOMEN' S GARMENT

This application is a continuation of Ser. No. 07/964,961, now abandoned.

This invention relates generally to women's garments and, more particularly, to an adjustable inner breast cup insert assembly designed and fitted for swimsuits and exercise suits such as dancewear, leotards or similar bodywear.

BACKGROUND OF THE INVENTION

There has long been the need to provide for shape and support for the bust area of women under their garments. This is typically done with a brassiere. Further, in the case of some close-fitting garments made of stretchable material, especially swimsuits and active wear, there is a need to have the bust support built in or attached directly to the garment.

Conventional swimsuits are generally made with three different treatments at the bust area. Suits may have no lining at the bust area, or a shelf bra which consists of a piece of fabric attached at the neckline and side seams of swimsuits that hangs loosely at the bust, or a constructed suit which has a pre-formed or stitched pair of cups or a bra attached to the swimsuit. The latter suit is intended to provide support and shape to the breast, but since they are not properly sized to the wearer, they fail to do a satisfactory job. These former swimsuit designs do not provide any support, lift or shape for the bust area. Unlined swimsuits or leotards press a woman's bust down and in addition to no support, give a less satisfactory contour. Frequently, these suits show a woman's nipples which most women dislike. A smaller busted woman tends to avoid these suits because of the flat chested appearance. Swimsuits or leotards with shelf bras do not give support or shape but do usually cover nipples and are preferred over nothing at all, primarily for modesty.

Additionally, the built-in brassiere is usually bulky and uncomfortable for the wearer. Large bosomed women fall out of the cup cavity while indentations to the cup appear on small busted women and generally do not give a natural appearance.

The present invention allows these problems with conventional swimsuits and other close-fitting garments of stretchable material to be remedied. The inner breast cup insert assembly of the present invention provides proper bust fit, support, comfort and shape to the individual wearer who currently cannot find any other way of doing this. Additionally, this invention provides the advantages of a brassiere, but is hidden from view for a natural look. It provides flexibility of fit, choice of size, proper support, comfort, shape and desired look to the wearer.

The breast cup insert assembly and the swimsuit (or other garment) are selected separately according to the wearer's size and fit which distinguishes this invention from other suits currently on the market. A bra size consists of two dimensions, the cup size which relates to bust development, and the band size which relates to chest size. As a women's bust size and body size are mutually exclusive, in that for example a size 12 woman can have a bosom development categorized as 34 A, B, C or D, while a woman wearing a size 16 might have any one of those sizes, the wearer can select her exact brassiere size and a swimsuit in her body size. The invention allows the wearer to select her correct cup and band size which provides proper comfort, lift, fit and support to the bosom. Additionally, the wearer has a choice of inner breast cup insertion depending on the type, shape or purpose desired such as, a normal soft cup construction, an underwire cup construction, a slightly padded cup construction, a fully padded cup construction, or a push up construction (giving a small bosom a more fuller, rounder appearance).

BRIEF SUMMARY OF THE INVENTION

The invention consists of an inner breast cup insert assembly which is attached to the inside of a swimsuit or close-fitting garment made from stretchable material. The insert assembly consists of two breast cups set in a frame having two side extensions and two vertical extensions. Attached to each side extension and vertical extension is a suitable connecting means such as hook and loop type fasteners. Attached to the inside of the swimsuit, bodysuit, blouse or other close-fitting garment of stretchable material are complimentary hook and loop type fasteners or other suitable connecting means. It is to be understood that the hook side may be on either the insert assembly or the garment while the loop side goes on the other. The inner breast cup insert assembly is attached to and anchored in the swimsuit or close-fitting garment by the connecting means, thereby providing proper fit, support, comfort, and shape to the wearer.

In a preferred embodiment of the invention, the inner breast construction is positioned and attached and detached at the inner sides, front or back and at the underside of the shoulder section of the outer garment and is adjustable. This adjustability provides a proper and better fit to the wearer because the inner breast cup construction can be positioned more accurately on the body and attached to the side of the garment according to the preference of the wearer.

The invention can also be used to provide for balance and natural appearance post mastectomy.

It is the principle object of the present invention to provide an inner breast cup insert assembly to provide proper fit and support of a wearer's breasts in a swimsuit, leotard, bodysuit or other garment of stretchable material.

It is a further object of the invention to provide an inner breast cup insert assembly that is interchangeable between a plurality of swimsuits and other close-fitting garments of stretchable material.

It is also an object of the invention to provide swimsuits with an insertable inner breast cup construction by which the wearer selects the proper cup construction that fits her dimensions and attaches the inner breast construction to the swimsuit of her choice.

It is an additional object of the invention to provide the wearer a choice of contours and styles of the inner breast cup construction designed to match the wearer's needs, such as natural cup, slightly padded, fully padded, underwire, push-up or any other configuration.

It is another object of the invention to provide improved breast support by accommodating the width and depth dimensions of the wearer's breasts in swimsuits or active wear garments when engaged in strenuous activity.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 3:
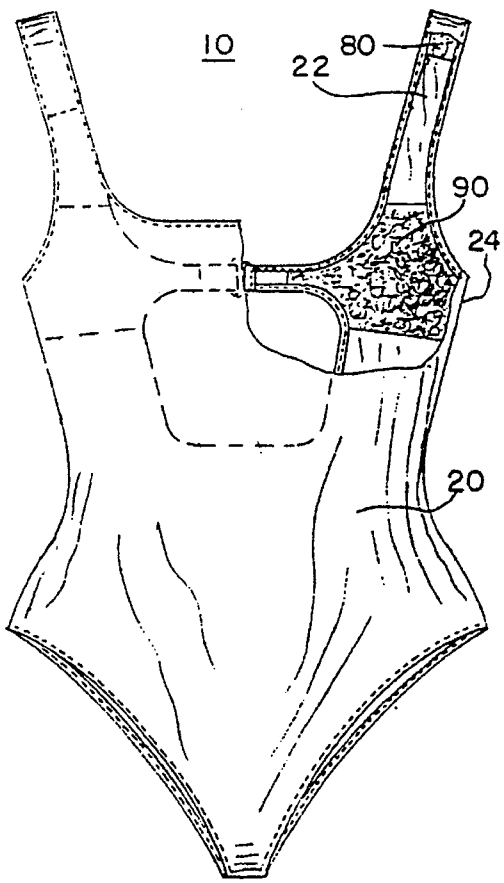
FIG. 3 is a partially cut away front view of the swimsuit of the present invention.

While the invention is susceptible of embodiment in many different forms there is shown in the drawings and will be described herein in detail, a preferred embodiment of the invention along with several alternate embodiments. It should be understood, however, that the present disclosure is to be considered an exemplification of the principles of the invention and is not intended to limit the spirit and scope of the invention and/or claims of the embodiment illustrated.

Figure 6:
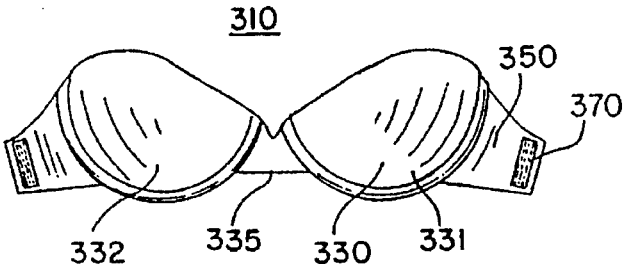
FIG. 6 is a front view of an alternate embodiment of the inner breast cup insert assembly of the present invention.
Figure 8:
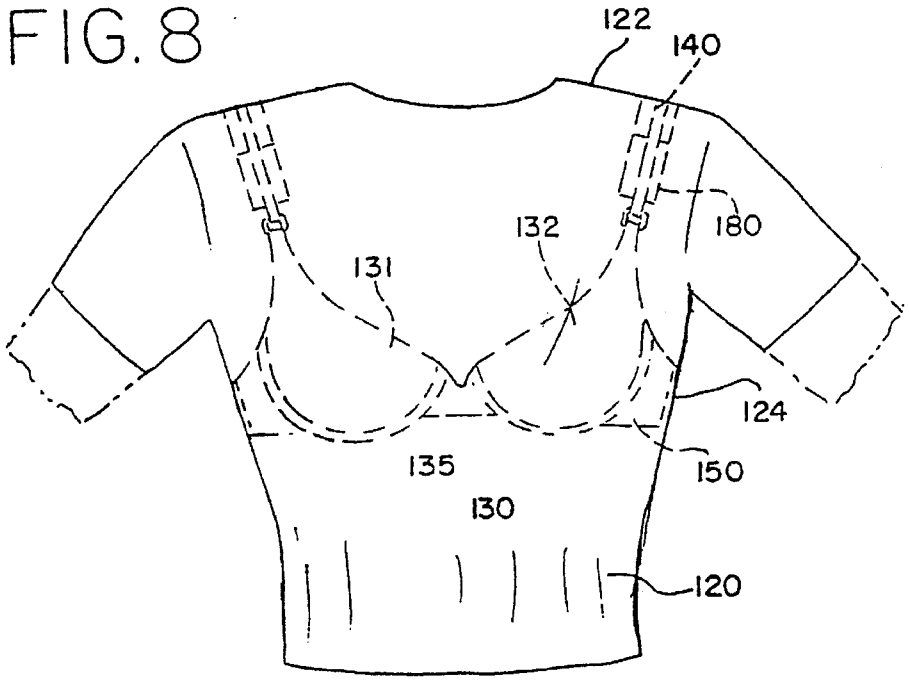
FIG. 8 is a rear view of the alternate embodiment of the present invention of FIG. 7.
Figure 7:
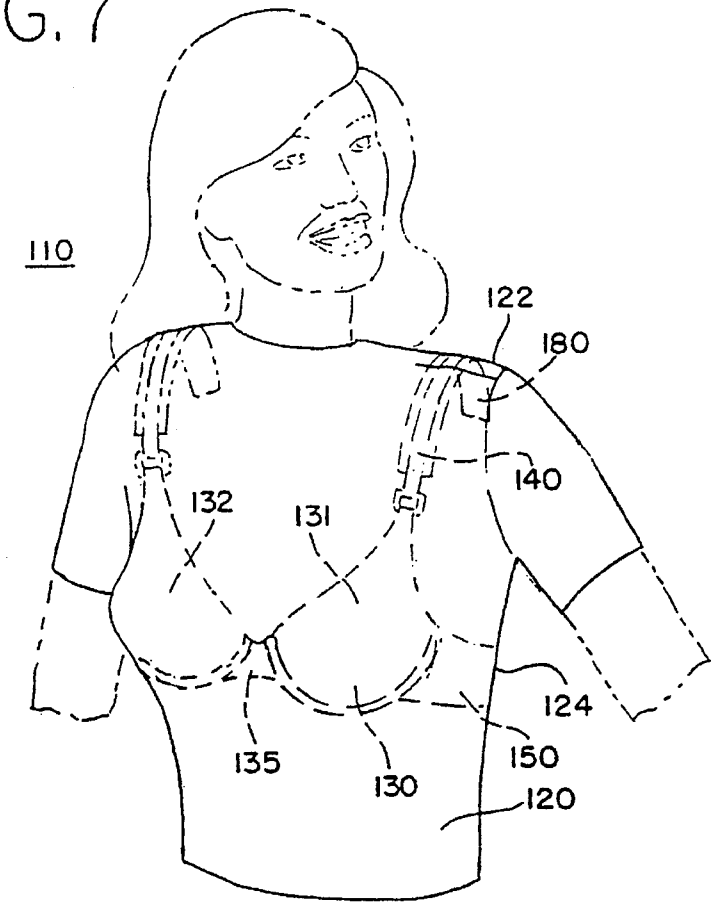
FIG. 7 is a perspective view of an alternate embodiment of the present invention.

FIGS. 1–5 illustrate the present invention 10 used in connection with a swimsuit 20 and comprising inner breast cup insert assembly 30. FIG. 6 illustrates an alternate embodiment of an inner breast cup insert assembly 310 for use in a "bandeau" swimsuit. FIGS. 7 and 8 illustrate an alternate embodiment of the invention 110 comprising garment 120 (which should be understood as representing any close-fitting garment made from stretchable material) and inner breast cup insert assembly 130. FIGS. 9 through 14 illustrate an alternate embodiment of the invention 210 in which the inner breast cup insert assembly and the swimsuit or garment are manufactured as a single integral article rather than two separate articles. The swimsuit or garment may be formed of any suitable fabric and may be of any suitable style, color, print, etc.

As illustrated, swimsuit 20 has shoulder straps 22 and side seams 24. However, the swimsuit may be formed of any suitable fabric and may be of any suitable style. Attached to the inner side of the shoulder straps 22, are strips of fastening material 80. Fastening material 80 preferably consists of hook and loop type fasteners; however, may be any suitable fastening material, adhesive or connecters known in the art. Attached to the inner side of side seams 24, at the arm pit area, are panels of fastening material 90. Fastening material 90 preferably consists of hook and loop type fasteners; however, may be any suitable fastening material or connecters. The fastening material is preferably secured to the swimsuit 20 by stitching.

Inner breast cup insert assembly 30 is of one piece construction and consists of two breast cups 31, 32 connected at midsection 35, each cup having a vertical extension 40 and a side extension 50. Attached to the outer side of the vertical extensions 40, are strips of fastening material 60. Fastening material 60 preferably consists of hook and loop type fasteners; however, may be any suitable fastening material or connecters. Attached to the outer side of the side extensions 50, are small panels of fastening material 70. Fastening material 70 preferably consists of hook and loop type fasteners; however, may be any suitable fastening material or connecters. The fastening material is preferably secured to the inner breast cup insert assembly 30 by stitching.

As illustrated in the alternate embodiment of the invention 110, garment 120 has shoulders 122 and side seams 124. However, the garment 120 may be formed of any suitable fabric and may be of any suitable style. Attached to the inner side of the shoulders 122, are strips of fastening material 180. Fastening material 180 preferably consists of hook and loop type fasteners; however, may be any suitable fastening material, adhesive or connecters known in the art. Attached to the inner side of side seams 124, at the arm pit area, are panels of similar fastening material. The fastening material is preferably secured to the garment 120 by stitching.

Inner breast cup insert assembly 130 is of one piece construction and consists of two breast cups 131, 132 connected at midsection 135, each having a vertical extension 140 and a side extension 150. Attached to the outer side of the vertical extensions 140, are strips of fastening material. This fastening material preferably consists of hook and loop type fasteners; however, may be any suitable fastening material or connecters. Attached to the outer side of the side extensions 150, are small panels of similar fastening material. The fastening material is preferably secured to the inner breast cup insert assembly 130 by stitching.

As illustrated in the alternate embodiment of the invention 310, inner breast cup insert assembly 330 has only side extensions 350 and no vertical extensions. Insert assembly 330 is intended, but not limited for use in a strapless swimsuit known as a "bandeau."

As illustrated in the alternate embodiment of the invention 210, swimsuit 220 (which should be understood as representing both swimsuits and garments) and inner breast cup insert assembly 230 are manufactured as one integral article. One of the extensions is permanently affixed to the swimsuit 220 while the other of the extensions contains fastening material to maintain adjustability of the insert assembly 230 and the swimsuit 220.

Figure 2:
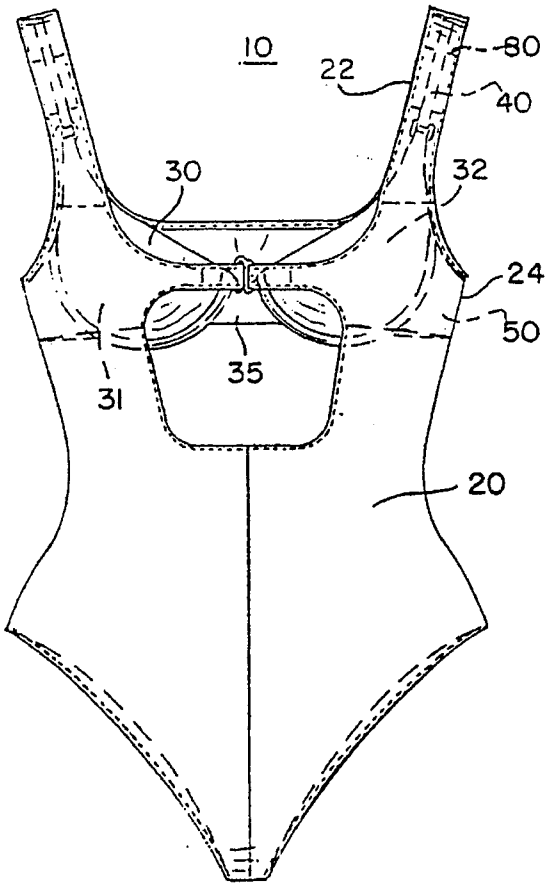
FIG. 2 is a rear view of the present invention of FIG. 1.
Figure 1:
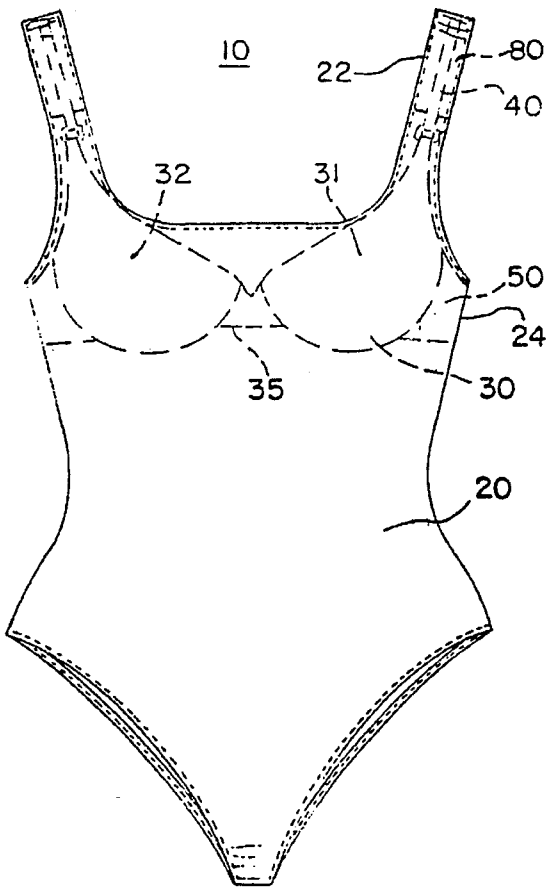
FIG. 1 is a front view of one embodiment of the present invention.

FIGS. 1 and 2 show swimsuit 20 having shoulder straps 22 and side seams 24. Fastening material 80 is shown stitched to the inner side of shoulder straps 22. Inner breast cup insert assembly 30 is shown in its inserted position. Inner breast cup insert assembly 30 has cups 31 and 32 connected at midsection 35. Cups 31 and 32 have vertical extensions 40 and side extensions 50.

FIG. 3 shows swimsuit 20 without inner breast cup insert assembly 30. Swimsuit 20 has shoulder straps 22 and side seams 24. Strips of fastening material 80 are attached to shoulder straps 22. Panels of fastening material 90 are attached to side seams 40 at the arm pit area of swimsuit 20.

Figure 4:
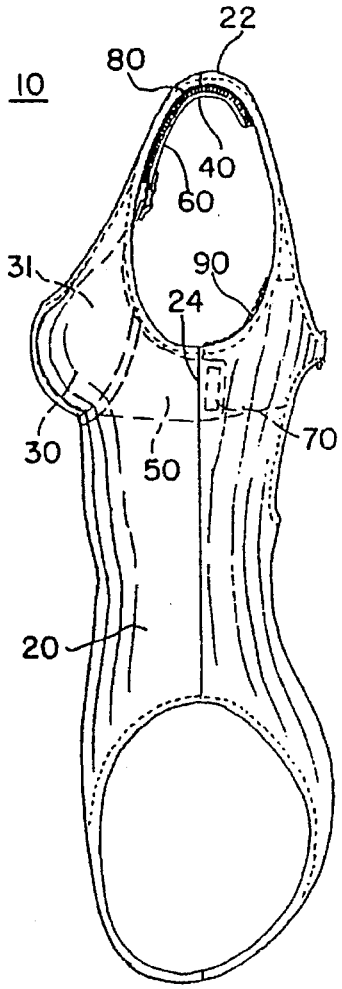
FIG. 4 is a side view of the present invention.

FIG. 4 shows a side view of swimsuit 20 with inner breast cup insert assembly 30 in its inserted position. Swimsuit 20 has shoulder straps 22 with strips of fastening material 80 attached thereto, and side seams 24 with panels of fastening material 90 attached thereto. Inner breast cup insert assembly 30 with cup 31, vertical extensions 40 and side extensions 50 is inserted into swimsuit 20. Fastening material 60 on vertical extensions 40 is connected to fastening material 80 on shoulder straps 22. Similarly, fastening material 70 on side extension 50 is connected to fastening material 90 on side seam 24.

Figure 5:
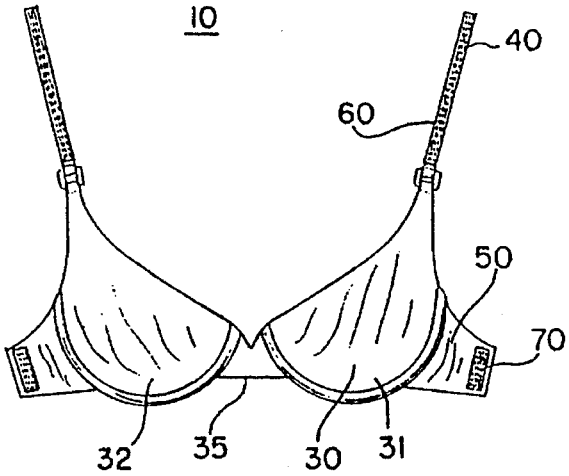
FIG. 5 is a front view of the inner breast cup insert assembly of the present invention.

FIG. 5 shows inner breast cup insert assembly 30 having cups 31, 32 connected at midsection 35. Cups 31, 32 each have a vertical extension 40 and a side extension 50. Attached to vertical extensions 40 is fastening material 60. Attached to side extension 50 is fastening material 70.

FIG. 6 shows an alternate embodiment of the present invention 310. The inner breast cup insert assembly 330 contains two breast cups 331, 332 connected at midsection 335. Insert assembly 330 further comprises side extensions 350 having fastening material 370. Insert assembly 330 has no vertical extensions and therefore, is suitable for application in a strapless swimsuit, such as a "bandeau," having complimentary fastening material at its side seams.

FIGS. 7 and 8 show an alternate embodiment of the invention 110. Garment 120 is shown with inner breast cup insert assembly 130 in its inserted position. Garment 120 has shoulders 122 with fastening material 180 connected thereto, and side seams 124 with fastening material (not shown) connected thereto. Inner breast cup insert assembly 130 has cups 131, 132 connected at midsection 135. Cups 131, 132 have vertical extensions 140 with fastening material (not shown) connected thereto, and side extensions 150 with fastening material (not shown) connected thereto.

Figure 9:
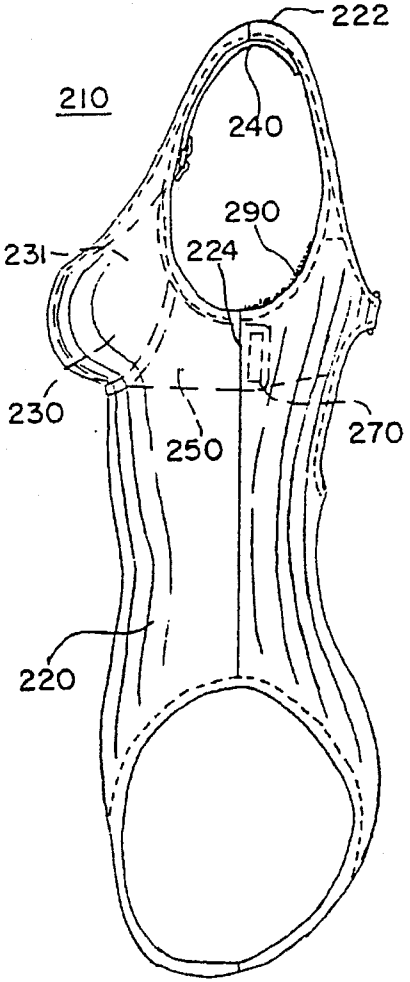
FIG. 9 is a side view of another alternate embodiment of the present invention.

FIG. 9 illustrates an alternate embodiment of the present invention 210 in which the vertical extensions 240 of the inner breast cup insert assembly 230 are permanently attached to the shoulders 222 through stitching or other suitable means. Swimsuit 220 (or garment) has a panel of fastening material 290 fixedly attached at the side seam or underarm area 224. Inner breast cup insert assembly 230 loosely hangs inside the swimsuit 220 (or garment). Side extension 250 of the insert assembly 230 contain a strip of complimentary fastening material 270 at the end thereof. Fastening material 270 is adjustably positioned on fastening material 290 to provide proper shape, support, etc. to the wearer.

Figure 10:
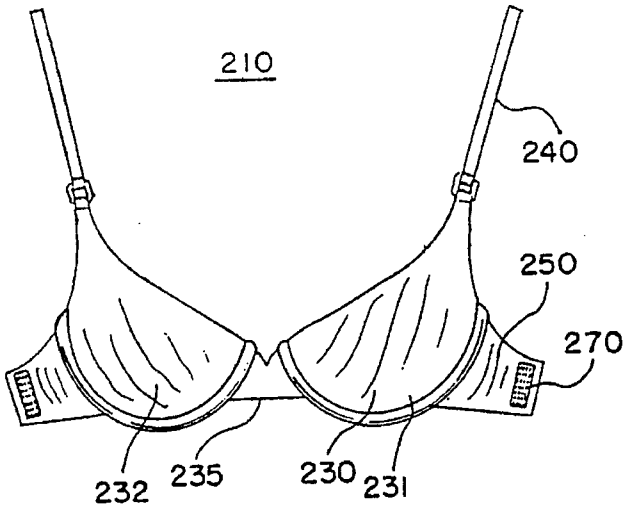
FIG. 10 is a front view of the inner breast cup insert assembly of the embodiment of FIG. 9.

FIG. 10 shows the inner breast cup insert assembly 230 of the invention 210 illustrated in FIG. 9. Insert assembly 230 contains two breast cups 231, 232 connected at a midsection 235, side extensions 250, and vertical extensions 240. Side extensions 250 have a strip of fastening material 270 affixed thereon at the end of the extension. Vertical extensions 240 are fixedly attached to the shoulders 222 of a swimsuit 220 or garment by any suitable means such as by stitching. The cups 231, 232 and side extensions 270 would then hang freely within the swimsuit 220 or garment and can be adjustably positioned therein as desired.

Figure 11:
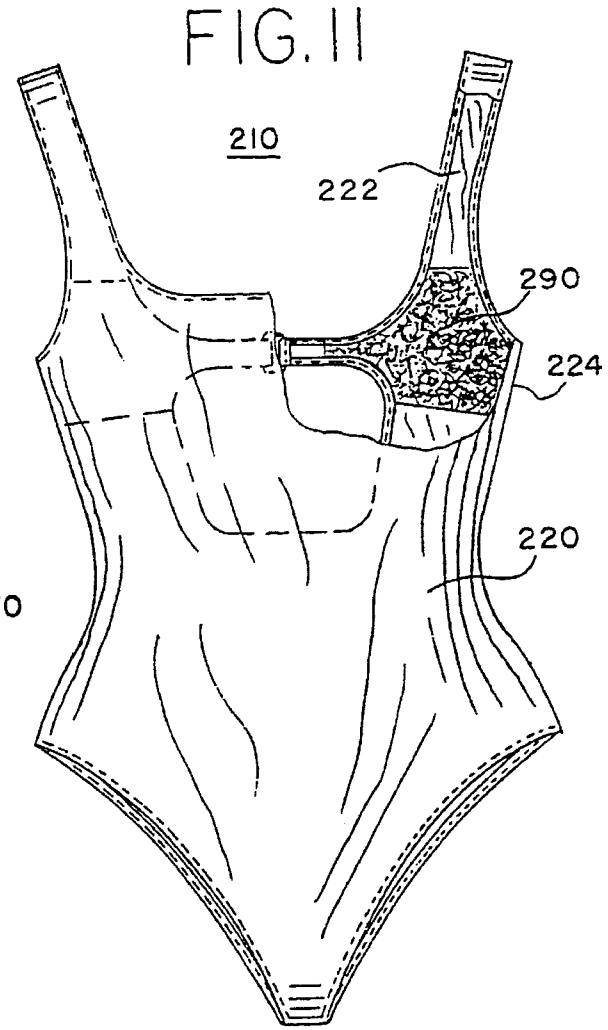
FIG. 11 is a partially cut away front view of the garment of the embodiment of FIG. 9.

FIG. 11 shows the swimsuit 220 (or garment) of the invention 210 illustrated in FIG. 9. Swimsuit 220 (or garment) has shoulders 222 and side seams or underarm areas 224. Fastening material 290 is placed towards the back of underarm area 224. Fastening material 290 may be any shape or size, or may be placed in any suitable location, so long as fastening material 270 of side extensions 250 can be suitably adjustable.

Figure 12:
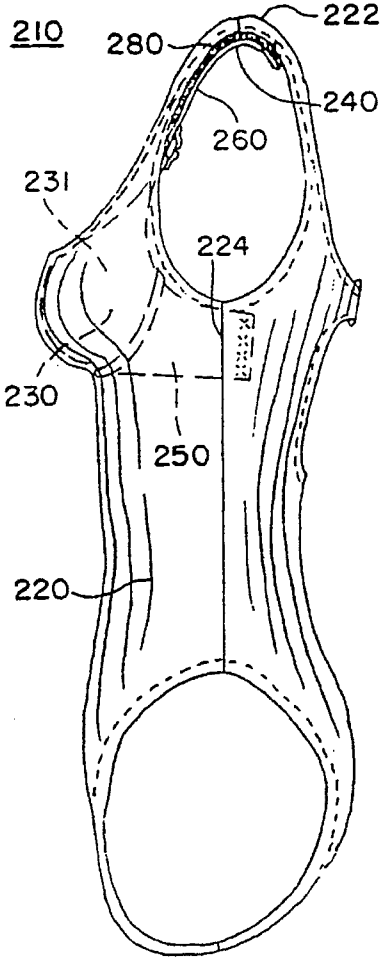
FIG. 12 is a side view of yet another alternate embodiment of the present invention.

FIG. 12 illustrates an alternate embodiment of the present invention 210 in which the side extensions 250 of the inner breast cup insert assembly 230 are permanently attached to the side seams or underarm areas 224 of swimsuit 220 (or garment) through stitching or other suitable means. Swimsuit 220 (or garment) has a strip of fastening material 280 fixedly attached at the shoulders 222. Vertical extensions 240 of the insert assembly 230 contains a strip of complimentary fastening material 260 along the length thereof. Fastening material 260 is adjustably positionable on fastening material 280 to provide proper shape, support, etc. to the wearer.

Figure 13:
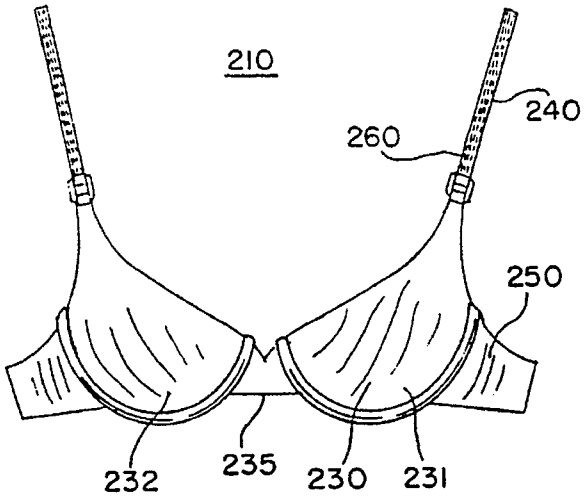
FIG. 13 is a front view of the inner breast cup insert assembly of the embodiment of FIG. 12.

FIG. 13 shows the inner breast cup insert assembly 230 of the invention 210 illustrated in FIG. 12. Insert assembly 230 contains two breast cups 231, 232 connected at a midsection 235, side extensions 250, and vertical extensions 240. Vertical extensions 240 have a strip of fastening material 260 affixed thereon along the length of the extensions. Side extensions 250 are fixedly attached to the side seam or underarm area 224 of swimsuit 220 (or garment) by any suitable means such as by stitching. The cups 231, 232 and vertical extension 240 are free to move within the swimsuit 220 or garment and can be adjustably positioned therein as desired.

Figure 14:
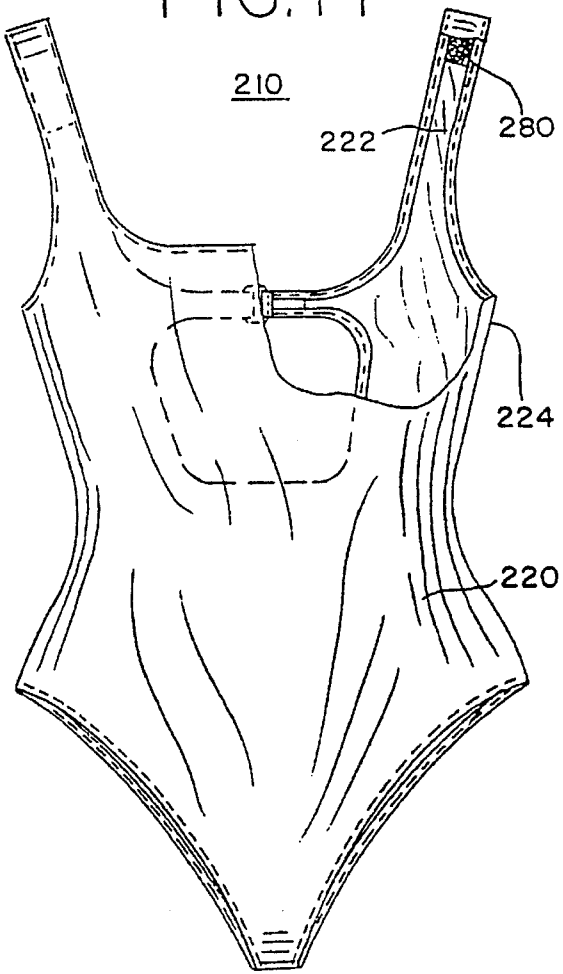
FIG. 14 is a partially cut away front view of the garment of the embodiment of FIG. 12.

FIG. 14 shows the swimsuit 220 (or garment) of the invention 210 illustrated in FIG. 12. Swimsuit 220 (or garment) has shoulders 222 and side seams or underarm areas 224. Fastening material 280 is placed on the shoulder areas 222, inside the swimsuit 220 or garment. Fastening material 280 may be any shape or size, or may be placed in any suitable location, so long as fastening material 260 of vertical extensions 240 can be suitably adjustable.

In use, for example, in a swimsuit 20, the inner breast cup construction assembly has the function and appearance of part of a brassiere, but is completed by the body and straps of the suit and has improved fitting characteristics. The inner breast cup construction is made without shoulder straps or back closure. Extending vertically from the breast cups along the vertical extensions is a strip of fastening material such as hook and loop type fasteners. At each side extension, a small rectangular panel of fastening material is attached. The strip of fastening material extending vertically from the cups attaches to the swimsuit at the shoulder straps. The small panel of fastening material on the side extensions attaches to the swimsuit at the side seams. Thus, the inner breast cup insert assembly is securely anchored in the swimsuit and in a sense becomes part of the swimsuit or is hidden within the swimsuit.

Alternatively, if a strapless swimsuit, called a "bandeau," is to be worn, the inner breast cup insert assembly can be manufactured without vertical extensions (see FIG. 6). The breast cups then would only have side extensions which would fasten to the sides of the bandeau. All other aspects of the insert assembly would remain the same.

To provide proper fit, the inner breast cup insert assembly is adjustable. The wearer attaches the straps and side extensions of the inner breast cup insert assembly according to her preference and amount of lift and support desired. The wearer can adjust the vertical and side extensions by positioning them on the shoulder straps and side seams of the swimsuit. The outer shell of the swimsuit will stretch over the insert assembly.

This adjustable bust cup construction has the function and appearance of a partial brassiere which is completed by the body and straps of the suit which hosts it. The adjustable bust cup construction is made without shoulder straps or back closure. It has fitting features of a brassiere, but it has the ability to be hidden within the suit, where a brassiere could not be worn satisfactorily.

The inner breast cup construction of the present invention will allow the wearer to choose the correct breast cup size according to the preference and purpose of the wearer. Therefore, the inner breast cup insert assembly will provide proper fit and comfort to the wearer.

The inner breast cup insert assembly is marketed separately from the swimsuit or garment. This allows the wearer the choice of the desired insert assembly for the associated swimsuit or garment while providing the desired fit, comfort and support. Also, one insert assembly could be inserted into several different swimsuits or close-fitting garments such as leotards, dancewear, etc. Similarly, different insert assemblies could be inserted into the same swimsuit or garment, thereby allowing more than one person to wear, i.e. share, the same swimsuit or garment if desired.

For definitional purposes, the vertical extensions 40 and the side extensions 50 can be referred to as lifting extensions and lateral extensions, respectively. Likewise, as seen in the drawing figures, the vertical extensions and side extensions have patches of fastening material 60 and fastening material 70 mounted thereto, which can be referred to as lifting extension patches and lateral extension patches, respectively. Similarly, shoulders or shoulder straps 22 and sides or side seams 24 can be referred to as shoulder portions and lateral portions, respectively. Likewise, as seen in the drawing figures, the shoulders and sides have patches of fastening material 80 and fastening material 90 mounted thereto, which can be referred to as shoulder portion patches and lateral patches, respectively. As further can be seen in the drawing figures, lifting extension patches and lateral extension patches each define an areal dimension having a length and a width: and shoulder portion patches and lateral patches each define an areal dimension having a length and a width. Preferably, the areal dimensions of the shoulder portion patches and lateral patches are greater than the areal dimensions of the lifting extension patches and the lateral extension patches, respectively, such that the lifting extensions and lateral extensions are capable of being fastened to the shoulder portions and lateral portions, respectively, in different lateral and transverse positions and angular orientations.

In an alternate embodiment of the invention, the inner breast cup insert assembly is marketed together with and attached to the swimsuit or garment. Invention 210 is similar to inventions 10 and 110, but has one important distinction. Instead of both the vertical extensions and the side extensions having fastening material and the swimsuit or garment having complimentary fastening material, only one of the two types of extensions contain fastening material and the swimsuit or garment having only one area of complimentary fastening material. The extensions without the fastening material are fixably attached to the garment by stitching or other suitable means.

For example, vertical extensions 240 could be stitched directly to shoulders 222 of the swimsuit or garment 220. Only side extensions 250 would contain fastening material 270. Swimsuit or garment 220 would only contain fastening material 290. The inner breast cup insert would be adjustable laterally by positioning fastening material 270 on fastening material 290, to provide desired support.

Conversely, side extensions 250 could be stitched directly to the under arm area or side seam 224 of the swimsuit or garment 220. Only vertical extensions 240 would contain fastening material 260. Swimsuit or garment 220 would only contain fastening material 280. The inner breast cup insert would be adjustable vertically by positioning fastening material 260 on fastening material 280, to provide desired support.

It is to be understood that the embodiments herein described are merely illustrative of the principles of the present invention. Various modifications may be made by those skilled in the art without departing from the spirit or scope of the claims which follow.

I claim:

1. A bodywear construction for improved support of a wearer's bust, comprising:

a garment having a first type of fastener thereon:

a breast cup insert cooperatively associated with said garment and having a second type of fastener thereon;

said first type of fastener cooperating with said second type of fastener to permit fastening and adjustment of a position of said insert with respect to said garment according to a wearer's bust projection and position within said garment;

wherein said garment further comprises a chest portion, two lateral portions extending from said chest portion, and two shoulder portions extending from said chest portion, each of said shoulder portions and said lateral portions having said first type of fastener thereon;

wherein said insert further comprises two cup members, with a lifting extension and a lateral extension extending from each of said cup members, each of said lifting extensions and said lateral extensions having a distal end with said second type of fastener disposed adjacent each of said distal ends;

each of said shoulder portions of said garment providing lifting support to said insert via said first and second types of fastener and said lifting extensions.

2. The bodywear construction according to claim 1, wherein said garment is comprised of a stretchable, elastic fabric and wherein said lifting extensions and said lateral extensions are constructed of an inelastic fabric.

3. The bodywear construction according to claim 1, wherein said garment, in conjunction with said insert, forms a torso-encircling bra assembly which provides lateral and vertical support to a wearer's bust.

4. The bodywear construction according to claim 1, wherein one of said first and second types of fastener is fabric comprised of hooks and the other of said first and second types of fastener is fabric comprised of loops.

5. The bodywear construction according to claim 1, wherein said first type of fastener is disposed on lateral patches attached to said garment on said lateral portions, and wherein said second type of fastener is disposed on lateral extension patches attached to said lateral extensions of said insert;

said lateral patches having an areal dimension which is larger than an areal dimension of said lateral extension patches to permit adjustment of said lateral extension patches with respect to said lateral patches.

6. The bodywear construction according to claim 5, wherein said areal dimension of said lateral extension patches is defined by a length and a width, said lateral patches extending in a lateral direction for a distance greater than said length and extending in a transverse direction substantially perpendicular to said lateral direction for a distance greater than said width to allow said lateral extension patches to be fastened to said lateral portions in different lateral and transverse positions and angular orientations with respect to said lateral portions to accommodate said wearer's bust projection and position.

7. The bodywear construction according to claim 1, wherein said first type of fastener is disposed on shoulder portion patches attached to said garment on said shoulder portions, and wherein said second type of fastener is disposed on lifting extension patches attached to said lifting extensions of said insert;

said shoulder portion patches having an areal dimension which is larger than an areal dimension of said lifting extension patches to permit adjustment of said lifting extensions with respect to said shoulder portions.

8. The bodywear construction according to claim 7, wherein said areal dimension of said lifting extension patches is defined by a length and a width, said shoulder portion patches extending in a lateral direction for a distance greater than said length and extending in a transverse direction substantially perpendicular to said lateral direction for a distance greater than said width to allow said lifting extension patches to be fastened to said shoulder portions in different lateral and transverse positions and angular orientations with respect to said shoulder portions to accommodate said wearer's bust projection and position.

9. The bodywear construction according to claim 1, wherein said first type of fastener is disposed on lateral patches attached to said garment on said lateral portions, and wherein said second type of fastener is disposed on extension patches attached to said lateral extensions of said insert;

said lateral patches having an areal dimension which is larger than an areal dimension of said lateral extension patches to permit adjustment of said lateral extension patches with respect to said lateral patches;

wherein said first type of fastener is disposed on shoulder portion patches attached to said garment on said shoulder portions, and wherein said second type of fastener is disposed on lifting extension patches attached to said lifting extensions of said insert;

said shoulder portion patches having an areal dimension which is larger than an areal dimension of said lifting extension patches to permit adjustment of said lifting extensions with respect to said shoulder portions.

10. The bodywear construction according to claim 9, wherein said areal dimension of said side and lifting extension patches are defined by a length and a width, said lateral and shoulder patches extending in a lateral direction for a distance greater than said length and extending in a transverse direction substantially perpendicular to said lateral direction for a distance greater than said width to allow said side add lifting extension patches to be fastened to said lateral and shoulder portions in different lateral and transverse positions and angular orientations with respect to said lateral and shoulder portions to accommodate said wearer's bust projection and position.

11. A bodywear construction for improved support of a wearer's bust, comprising:

a garment having a first type of fastener thereon;

a breast cup insert cooperatively associated with said garment and having a second type of fastener thereon;

said first type of fastener cooperating with said second type of fastener to permit said insert to be removed from said garment and fastened within other garments having said second type of fastener therein according to a projection and position of a wearer's bust within said other garments;

wherein said garment further comprises a chest portion two lateral portions extending from said chest portion, and two shoulder portions extending from said chest portion, each of said shoulder portions and said lateral portions having said first type of fastener thereon;

wherein said insert further comprises two cup members, with a lifting extension and a lateral extension extending from each of said cup members, each of said lifting extensions and said lateral extensions having a free end with said second type of fastener disposed adjacent each of said free ends;

each of said lifting extensions cooperating with a respective one of said shoulder portions and each of said lateral extensions cooperating with a respective one of said lateral portions via said first and second types of fastener to allow a wearer to adjust and fasten said insert within said garment while said garment is being worn by said wearer.

12. A bodywear system for improved support of a wearer's bust, comprising:

a garment having a first type of fastener thereon;

a plurality of breast cup inserts each configured to fit a bust projection of an associated wearer, each of said associated wearer having a bust which assumes a different projection and position with respect to said garment;

means cooperating with said garment for permitting removable fastening of a selected one of said inserts within said garment and adjustment of said selected insert to a position coinciding with the projection and position of the bust of said wearer associated with said selected insert with respect to said garment;

wherein said garment further comprises a chest portion, two lateral portions extending from said chest portion, and two shoulder portions extending from said chest portion, each of said shoulder portions and said lateral portions having said means for permitting thereon;

wherein said insert further comprises two cup members, with a lifting extension and a lateral extension extending from each of said cup members, each of said lifting extensions and said lateral extensions having a distal end with said means for permitting disposed adjacent each of said distal ends;

each of said shoulder portions of said garment providing lifting support to said insert via said means for permitting and said lifting extensions.

13. The bodywear system according to claim 12, wherein said means for permitting comprises a first type of fastener attached to said garment and a second type of fastener attached to said inserts.

14. The bodywear system according to claim 13, wherein one of said first and second types of fastener is comprised of a fabric having hooks and the other of said first and second types of fastener is comprised of a fabric having loops.

15. A garment for improved support of a wearer's bust, comprising:

a chest portion and two lateral portions extending from said chest portion, each of said lateral portions having a first type of fastener thereon, said first type of fastener adapted to engage a second type of fastener on a breast cup insert and to permit fastening and adjustment of said breast cup insert within said garment according to a position and projection of said wearer's bust;

wherein said garment further comprises two shoulder portions extending from said chest portion, said first type of fastener additionally being disposed on each of said shoulder portions and adapted to engage said second type of fastener on said breast cup insert;

wherein sale insert further comprises two cup members with a lifting extension and a lateral extension extending from each of said cup members, each of said lifting extensions and said lateral extensions having a distal end with said second type of fastener disposed adjacent each of said distal ends;

each of said shoulder portions of said garment providing lifting support to said insert via said first and second types fastener and said lifting extensions.

16. The garment according to claim 15, wherein said first type of fastener is a fabric patch disposed on said lateral portions and said shoulder portions.

17. The garment according to claim 16, wherein said fabric patches are comprised of loops or hooks.

18. A breast support assembly for improved support of a wearer's bust, comprising:

two cup members, with a lifting extension and a lateral extension extending from each of said cup members, each of said lifting extensions and said lateral extensions having a distal end with a first type of fastener disposed adjacent each of said distal ends;

said first type of fastener adapted to engage a second type of fastener in a garment to permit fastening and adjustment of said breast cup insert within said garment according to a position and projection of said wearer's bust;

wherein said garment further comprises a chest portion, two lateral portions extending from said chest portion, and two shoulder portions extending from said chest portion, each of said shoulder portions and said lateral portions having said second type of fastener thereon;

each of said shoulder portions of said garment providing lifting support to said insert via said first and second types of fastener and said lifting extensions.

19. The breast cup insert according to claim 18, wherein said first type of fastener is a fabric patch disposed on said lifting extensions and said lateral extensions.

20. The breast cup insert according to claim 19, wherein said fabric patches are comprised of hooks or loops.

* * * * *